United States Patent [19]

Ozawa

[11] Patent Number: 4,573,614

[45] Date of Patent: Mar. 4, 1986

[54] TONER VESSEL FOR COPYING MACHINE

[75] Inventor: Seiji Ozawa, Numazu, Japan

[73] Assignee: Ricoh, Ltd, Tokyo, Japan

[21] Appl. No.: 527,132

[22] Filed: Aug. 26, 1983

[30] Foreign Application Priority Data

Sep. 6, 1982 [JP] Japan ..... 57-134963[U]

[51] Int. Cl.[4] ..... B67D 3/00

[52] U.S. Cl. ..... 222/542; 222/561; 222/DIG. 1; 222/541; 206/525; 206/633; 220/258; 220/345

[58] Field of Search ..... 222/544, 559, 561, DIG. 1, 222/542, 541, 545; 220/345, 350, 256, 258; 206/525, 633

[56] References Cited

U.S. PATENT DOCUMENTS 2,413,923 1/1947 Kackley et al. ..... 222/DIG. 1
3,388,853 6/1968 Matich ..... 222/DIG. 1
3,999,654 12/1976 Pollack ..... 222/DIG. 1

*Primary Examiner*—Joseph J. Rolla
*Assistant Examiner*—Andrew Jones
*Attorney, Agent, or Firm*—Flynn, Thiel, Boutell & Tanis

[57] ABSTRACT

A toner vessel for use in a copying machine includes a square dish-shaped vessel body which is open at the upper part, is provided with an outwardly projecting flange at the peripheral edge of said opening and receives the toner therein. A cover sheet is folded on itself to define an upper part and a lower part. The opening of the vessel body is covered with the lower part of the folded cover sheet and the latter's periphery is fitted on said flange. The surface of the upper part, in the vicinity of the fore end of the upper part, is adhered to the back surface of a cover plate arranged movably in the horizontal direction on the surface of the cover sheet upper part.

3 Claims, 8 Drawing Figures

TONER VESSEL FOR COPYING MACHINE

FIELD OF THE INVENTION

This invention relates to a toner vessel for use in a copying machine.

BACKGROUND OF THE INVENTION

As a conventional vessel of this type, there is known the one as illustrated in FIG. 1A. This vessel 1 includes a square dish-shaped vessel body 2 which is opened at the upper part and provided with an outwardly projecting flange 3 at the peripheral edge portion of the opening. Toner 4 is received in this vessel body 2. A cover sheet 5 is folded upon itself at its rear (rightward) edge to form a double thickness and thus comprises a lower part 6 and an upper part 7, the former covering the opening, and the latter, which is superposed on the former, extending its fore end part 8 outside of the flange 3.

When the conventional toner vessel of this type is turned upside down and applied to a conventional copying machine (not shown) for use, as shown in FIG. 1B, the sheet 5 is peeled off from the flange 3 by pulling the sheet in the direction of the arrow with the end part 8, and thus the opening of the body 2 is gradually opened, whereby the toner 4 received in the vessel is allowed to fall on the developing area of the copying machine.

The conventional vessel of this type, however, was defective in that upon peeling the lower part 6 of the sheet 5 from the flange 3, the part 6 must be pulled out of the vessel 2, but the toner 4' adhered to the back of the lower part 6 tends to fall, at that time, onto portions inside or outside of the copying machine other than the developing area, thereby staining those portions.

SUMMARY OF THE INVENTION

It is an object of this invention to provide a toner vessel which is capable of eliminating the above mentioned drawbacks inherent to the conventional toner vessel and, upon applying the toner onto the developing area of the copying machine, is capable of preventing portions of the copying machine other than the developing area from being stained by toner falling thereon.

Said object can be achieved by the toner vessel of this invention, in which the fore end surface of an upper part of a cover sheet, which cover sheet is formed in the same manner with the above-mentioned conventional toner vessel cover sheet, is adhered to the back surface of the fore end of a cover plate secured slidably to the vessel body.

It is another object of this invention to provide a toner vessel which is simple in structure, can be manufactured cheaply and further can prevent the inside and outside portions, other than the developing area, of the copying machine from being stained by the falling toner.

Said object can be achieved by the toner vessel embodying this invention, wherein grooved portions, which are formed by inward bending both side flanges of the cover plate, are engaged on flange portions on both sides of the vessel body.

It is a further object of this invention to provide a toner vessel wherein the cover sheet, when pulled out, can move smoothly along the cover plate with no fear of separating from the cover plate and thus can effectively prevent the toneer from falling on the inside and outside portions, other than the developing area, of the copying machine.

Said object can be achieved by the toner vessel embodying this invention, wherein a through hole is provided in the vicinity of the rear end part of said cover plate, and the upper part of the cover sheet passes through this hole and thereafter extends along the back surface of the cover plate.

These and other features and advantages of this invention will become apparent upon reading the following specification, which, along with the patent drawings, describes and discloses a preferred illustrative embodiment of the invention in detail.

The detailed description of the specific embodiment makes reference to the accompanying drawings.

DETAILED DESCRIPTION OF THE INVENTION

Figure 3:
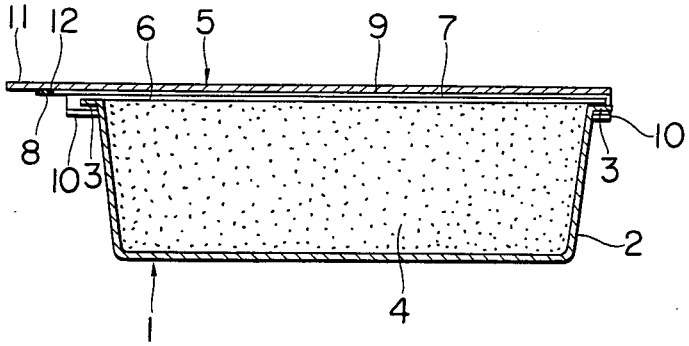
FIG. 3 is a sectional view taken on line 3—3 in the direction of the arrow of FIG. 2.

In FIG. 3 and FIG. 4 there is shown one embodiment of this invention. In this connection, it is to be noted that since this embodiment has many structural parts in common with the above-mentioned conventional toner vessel, the same reference symbols will be attached to the like parts for explanatory abridgment, and explanation will be made mainly with reference to mutually different parts.

In this embodiment, a cover plate 9 is disposed on an upper part 7 of a cover sheet 5 and both side flanges of said plate 9 are bent inward to thereby form bent parts 10. The grooved portions formed by these bent parts 10 are engaged on the flange portions 3 on both sides of the vessel body so that said cover plate 9 may move along these flange portions in the right or left direction in FIG. 3. Further, the surface of a fore end part 8 of the upper part 7 of the sheet 5 is adhered to the back surface of the cover plate 9, near to a fore end part 11 thereof, by using a bonding agent 12.

Figure 1A:
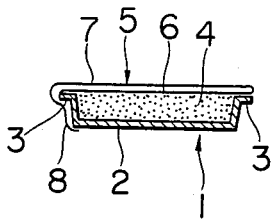
FIG. 1A PRIOR ART
FIG. 1A is a longitudinal front view illustrating the typical toner vessel of the conventional copying machine.
Figure 1B:
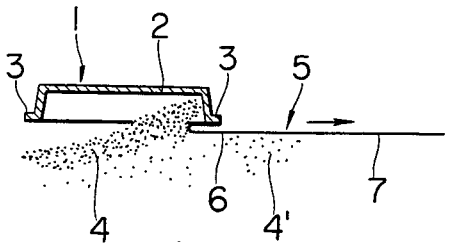
FIG. 1B PRIOR ART
FIG. 1B is a longitudinal front view showing the state of the toner vessel of FIG. 1A while in use.
Figure 2:
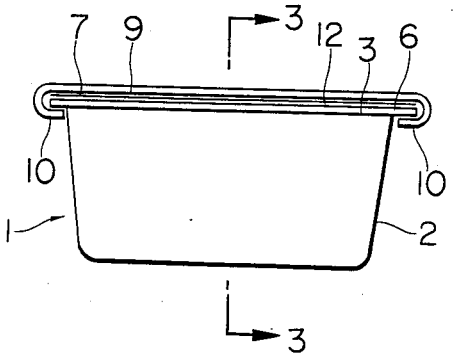
FIG. 2 is a front view of one embodiment of the toner vessel according to this invention.
Figure 4A:
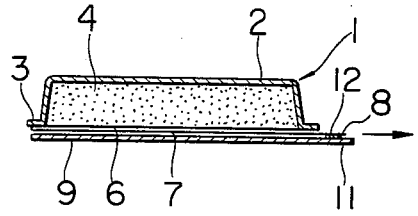
FIG. 4A is a sectional view illustrating the state of said embodiment of this invention at the early stage of its use.
Figure 4B:
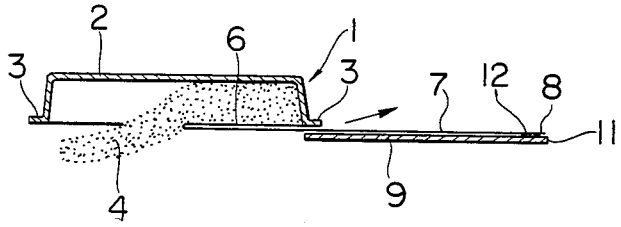
FIG. 4B is a sectional view illustrating the state of said embodiment following FIG. 4A.
Figure 4C:
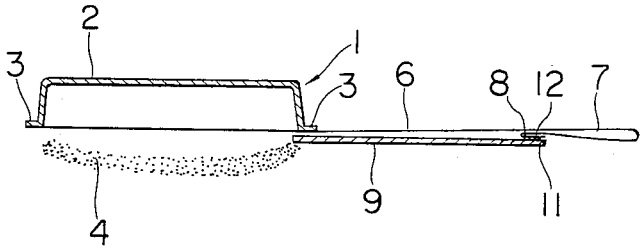
FIG. 4C ia a sectional view illustrating said embodiment at the last stage of use following FIG. 4B.

The manner of handling the inventive toner vessel above described is illustrated in FIG. 4A to FIG. 4C. FIG. 4A is similar to FIG. 1B and shows the state of said toner vessel upon being applied to the copying machine. Hereupon, an operator holds the fore end part 11 of the plate 9 with fingers and pulls it rightward in the direction of the arrow in the drawing.

FIG. 4B shows the state wherein the plate 9 has wholly been pulled out of overlap with the opening of the body 2, wherein although the part 7 of the sheet 5 is wholly pulled out of the body 2 together with the plate 9, the part 6 of the sheet 5 is only half-peeled out of the flange 3, which means that the opening of the vessel body 2 is only half opened, and the toner 4 falls gradually from the vessel body 2, as illustrated, as the vessel body opening is gradually opened. The part of the sheet 5 thus pulled out of the vessel 1 with the plate 9 is the part 7 which does not contact directly the toner 4, so there is no peril of the toner 4 being brought out of the vessel with this movement of the sheet 5, and accordingly there is no possibility of its neighbourhood being stained by the toner 4.

At this stage, the pulling-out of the plate 9 is stopped, the sheet 5 alone is pulled out as shown in FIG. 4C, and thus the opening of the vessel 1 is opened completely. Although it is the toner contacting part 6 of the sheet that is pulled out of the vessel 1 at this time, this toner contacting surface of the sheet part 6 is located opposite to the surface of the plate 9 so that the toner adhered to the part 6 is located wholly between the surface of the plate 9 and the back surface of the part 6 and so there is no possibility of the toner falling outward therefrom and staining its neighbourhood.

Figure 5:
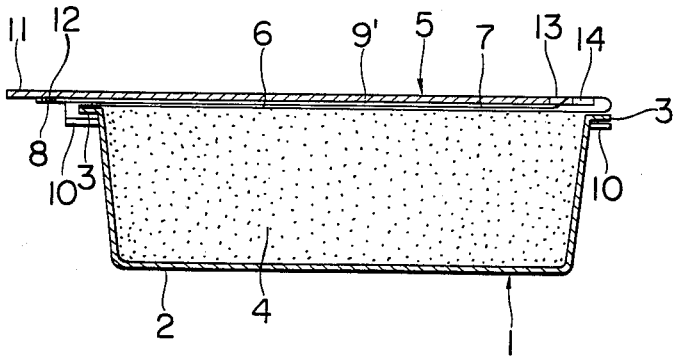
FIG. 5 is a sectional view similar to FIG. 3 illustrating another embodiment of the toner vessel according to this invention.

FIG. 5 shows another embodiment of this invention. This embodiment and the above mentioned embodiment are exactly the same with the exception that the plate 9' of this embodiment is provided with a through hole 13 in the vicinity of the rear end part thereof.

In this embodiment, the above mentioned through hole 13 is utilized to pass the part 7 of the sheet 5 therethrough with the result that the sheet 5 is held on the plate 9' through this through hole 13 and by means of the bonding agent 12, whereby the peeling operation of the sheet 5 can be carried out more smoothly and the toner can be effectively prevented from falling on not prearranged places. Furthermore, when the plate 9' is restored its original closed position, a fore end 14 of the plate thrusts the sheet 5 so that the sheet 5 may also be restored its original position.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A toner vessel for use in a copying machine indluding a square dish-shaped vessel body which has an opening at its upper part and is provided with an outwardly projecting flange at the peripheral edge portion of said opening, said vessel body receiving a toner therein, a cover sheet which is folded on itself so as to have an upper part and a lower part, said opening being covered with said lower part of said folded cover sheet, said upper part being superposed on said lower part and having a fore end portion extending beyond of the flange on said vessel body, a cover plate secured slidably to the upper part of the vessel body and having a back surface facing toward said cover sheet and vessel body, the fore end portion of said cover sheet upper part being adhered to the fore end of the back surface of said cover plate.

2. A toner vessel according to claim 1 wherein said cover plate has side flanges bent inward to form bent portions, and grooved portions formed by these bent portions are engaged, on both sides of the vessel body, with portions of the flange on said vessel body.

3. A toner vessel according to claim 1 or claim 2 wherein a through hole is formed in the vicinity of the rear end of said cover plate, and the upper part of said cover sheet passes through this through hole and thereafter extends along the back surface of the cover plate.

* * * * *